US010501838B2

(12) United States Patent
Oohashi et al.

(10) Patent No.: US 10,501,838 B2
(45) Date of Patent: Dec. 10, 2019

(54) COOLING DEVICE FOR HOT-DIP PLATED STEEL SHEET

(71) Applicant: NIPPON STEEL & SUMITOMO METAL CORPORATION, Tokyo (JP)

(72) Inventors: Tooru Oohashi, Kisarazu (JP); Kazuki Machida, Kimitsu (JP); Hiroshi Nakata, Kimitsu (JP); Katsuya Kojima, Spanish Fort, AL (US); Kohhei Hayakawa, Kisarazu (JP)

(73) Assignee: NIPPON STEEL CORPORATION, Tokyo (JP)

( * ) Notice: Subject to any disclaimer, the term of this patent is extended or adjusted under 35 U.S.C. 154(b) by 315 days.

(21) Appl. No.: 15/506,350

(22) PCT Filed: Oct. 24, 2014

(86) PCT No.: PCT/JP2014/078361
§ 371 (c)(1),
(2) Date: Feb. 24, 2017

(87) PCT Pub. No.: WO2016/063414
PCT Pub. Date: Apr. 28, 2016

(65) Prior Publication Data

US 2017/0275746 A1 Sep. 28, 2017

(51) Int. Cl.
*C23C 2/00* (2006.01)
*C23C 2/26* (2006.01)
*C23C 2/40* (2006.01)

(52) U.S. Cl.
CPC ..... *C23C 2/003* (2013.01); *C23C 2/26* (2013.01); *C23C 2/40* (2013.01)

(58) Field of Classification Search
None
See application file for complete search history.

(56) References Cited

U.S. PATENT DOCUMENTS 4,847,169 A * 7/1989 Sakai ..... C23C 14/16 428/659
5,574,328 A * 11/1996 Okuchi ..... B60Q 1/0011 313/114
2010/0200126 A1 8/2010 Onozawa et al.

FOREIGN PATENT DOCUMENTS

EP 2062992 A1 5/2009
JP 4-183844 A 6/1992
(Continued)

OTHER PUBLICATIONS

International Search Report for PCT/JP2014/078361 dated Jan. 27, 2015.
(Continued)

*Primary Examiner* — Jethro M. Pence
(74) *Attorney, Agent, or Firm* — Birch, Stewart, Kolasch & Birch, LLP

(57) ABSTRACT

The present invention provides a cooling device for a hot-dip plating device provided on an upper side of a plating thickness control device in a conveyance route of a hot-dip plated steel sheet that is conveyed from a plating bath in a vertically upward direction. The cooling device includes: a main cooling device that vertically sprays a main cooling gas to the hot-dip plated steel sheet; and a preliminary cooling device that is provided in a preliminary cooling section between the main cooling device and the plating thickness control device in the conveyance route, and sprays a preliminary cooling gas to a plurality of gas collision positions which are set along the preliminary cooling section.

7 Claims, 9 Drawing Sheets

(56) References Cited

FOREIGN PATENT DOCUMENTS

| | | | |
|---|---|---|---|
| JP | 11-106881 | A | 4/1999 |
| JP | 2002-161350 | A | 6/2002 |
| JP | 2003-049257 | A | 2/2003 |
| JP | 2004-59944 | A | 2/2004 |
| JP | 2004-59945 | A | 2/2004 |
| JP | 2008-115462 | A | 5/2008 |

OTHER PUBLICATIONS

Written Opinion of the International Searching-Authority for PCT/JP2014/078361 (PCT/ISA/237) dated Jan. 27, 2015.
Extended European Search Report, dated Jan. 31, 2018, for corresponding European Application No. 14904512.2.
Japanese Notice of Reasons for Rejection dated Nov. 21, 2017 in Japanese Patent Application No. 2016-555033.

* cited by examiner

COOLING DEVICE FOR HOT-DIP PLATED STEEL SHEET

TECHNICAL FIELD OF THE INVENTION

The present invention relates to a cooling device for a hot-dip plated steel sheet.

RELATED ART

In the related art, as a method of forming a metal film (plated layer) on a surface of a steel sheet, hot dip plating is known. In a typical hot-dip plating process, a steel sheet is immersed in a plating bath filled with a molten metal, and then the steel sheet is pulled up from the plating bath, thereby forming a plated layer on the surface of the steel sheet. Hereinafter, a steel sheet in which a plated layer is formed on a surface thereof through hot-dip plating is referred to as a hot-dip plated steel sheet.

After the hot-dip plated steel sheet is pulled up from the plating bath, iron contained in a steel sheet that is a base metal and a metal contained in the plated layer react with each other during solidification of the plated layer, and an alloy layer, which is hard and is likely to be broken, is generated between the steel sheet and the plated layer. The alloy layer causes peeling-off of the plated layer from the hot-dip plated steel sheet, and thus it is necessary to suppress generation of the alloy layer by compulsorily cooling down the hot-dip plated steel sheet that is pulled up from the plating bath.

As described above, a cooling condition of the hot-dip plated steel sheet is a very important factor that determines quality of the hot-dip plated steel sheet. For example, the following Patent Document 1 discloses a technology of securing quality required for the hot-dip plated steel sheet by controlling a flow rate of a cooling gas in correspondence with a temperature or a solidification state of the hot-dip plated steel sheet in a hot-dip plated steel sheet cooling process. However, the following problem exists in the cooling device for the hot-dip plated steel sheet of the related art.

FIG. 8A and FIG. 8B are views schematically showing a cooling device for the hot-dip plated steel sheet in the related art. FIG. 8A is a view when a cooling device 100 is seen from a width direction of a hot-dip plated steel sheet PS. FIG. 8B is a view when the cooling device 100 is seen from a thickness direction (direction perpendicular to a surface of the hot-dip plated steel sheet PS) of the hot-dip plated steel sheet PS. In FIG. 8A and FIG. 8B, an arrow Z indicates a conveyance direction of the hot-dip plated steel sheet PS. After being pulled up from a plating bath, the hot-dip plated steel sheet PS is conveyed along a vertically upward conveyance direction Z.

The cooling device 100 is provided on an upper side of a wiping nozzle (not shown) in a conveyance route of the hot-dip plated steel sheet PS. Furthermore, as is well known, the wiping nozzle is a nozzle that sprays a wiping gas to the surface of the hot-dip plated steel sheet PS to adjust the thickness of the plated layer. The cooling device 100 includes a pair of cooling gas spraying devices 101 and 102 which are disposed to face each other with the hot-dip plated steel sheet PS interposed therebetween.

The cooling gas spraying device 101 vertically sprays a cooling gas Gc to one surface of the hot-dip plated steel sheet PS. The cooling gas spraying device 102 vertically sprays a cooling gas Gc to the other surface of the hot-dip plated steel sheet PS. In this manner, when the cooling gas Gc is sprayed to both of the surfaces of the hot-dip plated steel sheet PS from the pair of cooling gas spraying devices 101 and 102, a descending gas stream Gd, which descends along both of the surfaces of the hot-dip plated steel sheet PS from an inlet of the cooling device 100, occurs.

On an inlet side of the cooling device 100, the plated layer of the hot-dip plated steel sheet PS is in a non-solidified state (state in which a thin oxide film is formed on a surface). In addition, a flow velocity of the descending gas stream Gd in the vicinity of the center in a width direction of the hot-dip plated steel sheet PS is faster than a flow velocity of the descending gas stream Gd in the vicinity of an edge of the hot-dip plated steel sheet PS. As a result, as shown in FIG. 8B, on an inlet side of the cooling device 100, a semilunar wrinkle (wind ripple) W occurs in the oxide film formed on the surface of the plated layer.

As described above, when the hot-dip plated steel sheet PS passes through the cooling device 100 in a state in which the semilunar wrinkle W occurs in the oxide film of the plated layer, the plated layer is solidified in a state in which the wrinkle W occurs. The hot-dip plated steel sheet PS having the wrinkle W is sorted as a poor-appearance article in an inspection process, and thus occurrence of the wrinkle W causes a decrease in a yield ratio of the hot-dip plated steel sheet PS. The wrinkle W significantly occurs in a case of forming a plated layer having a broad solidification temperature range such as an alloy plated layer of a multi-chemical composition system including, particularly, Zn—Al—Mg—Si and the like.

Examples of a method of avoiding occurrence of the wrinkle W include a method of decreasing a flow rate of the cooling gas Gc to limit the occurrence of the descending gas stream Gd, and the like. However, when the flow rate of the cooling gas Ge decreases, cooling power of the cooling device 100 deteriorates. As a result, there is a problem that it is difficult to sufficiently suppress generation of the alloy layer that causes peeling-off of the plated layer, or a decrease in productivity of the hot-dip plated steel sheet PS is caused.

For example, as a technology of limiting the occurrence of poor appearance (wrinkle W) without deteriorating the cooling power of the cooling device 100, the following Patent Document 2 discloses a technology of blocking the descending gas stream Gd, which is blown from the inlet of the cooling device 100 by providing a gas knife that sprays a gas to the surface of the hot-dip plated steel sheet PS in an obliquely upward direction from a lower side (inlet side) of the cooling device 100.

PRIOR ART DOCUMENT

Patent Document

[Patent Document 1] Japanese Unexamined Patent Application, First Publication No. H11-106881

[Patent Document 2] Japanese Unexamined Patent Application, First Publication No. 2004-59944

DISCLOSURE OF THE INVENTION

Problems to be Solved by the Invention

In a case of manufacturing the hot-dip plated steel sheet PS in which the thickness of the steel sheet that is a base metal is small and the thickness of the plated layer is small, the technology disclosed in Patent Document 2 is effective as a technology of limiting the occurrence of the poor appearance (wrinkle W).

However, when the thickness of the steel sheet that is the base metal increases, and the thickness of the plated layer also increases (when an adhered amount of plating increases), the oxide film on the surface of the plated layer may run down from the vicinity of the center in the width direction of the hot-dip plated steel sheet PS due to own weight. In this case, even when blocking the descending gas stream Gd blown from the inlet of the cooling device 100 by using the gas knife, there is a possibility that the semilunar wrinkle W may occur in the oxide film of the plated layer.

The invention has been made in consideration of the above-described situation, and an object thereof is to provide a cooling device for a hot-dip plated steel sheet which is capable of suppressing occurrence of a wrinkle in a surface (surface of a plated layer) of a hot-dip plated steel sheet during a process of manufacturing the hot-dip plated steel sheet in which the thickness of a steel sheet that is a base metal is large and the thickness of the plated layer is large.

Means for Solving the Problem

The invention employs the following means to accomplish the object by solving the above-described problem.

(1) According to an aspect of the invention, there is provided a cooling device for a hot-dip plated steel sheet which is provided on an upper side of a plating thickness control device in a conveyance route of a hot-dip plated steel sheet that is conveyed from a plating bath in a vertically upward direction. The cooling device includes: a main cooling device that vertically sprays a main cooling gas to the hot-dip plated steel sheet; and a preliminary cooling device that is provided in a preliminary cooling section between the main cooling device and the plating thickness control device in the conveyance route, and sprays a preliminary cooling gas to a plurality of gas collision positions which are set along the preliminary cooling section.

(2) In the cooling device for a hot-dip plated steel sheet according to (1), the preliminary cooling device may spray the preliminary cooling gas to each of the gas collision position in an obliquely upward direction, and the closer the gas collision position is to a lower stage of the preliminary cooling section, the smaller an angle, which is made by a spraying direction of the preliminary cooling gas and the conveyance direction of the hot-dip plated steel sheet, may become.

(3) In the cooling device for a hot-dip plated steel sheet according to (1) or (2), the preliminary cooling device may include a temperature sensor that detects a surface temperature of the hot-dip plated steel sheet at the gas collision position of at least the lowest stage, a first flow velocity sensor that detects a flow velocity of a gas stream that downwardly flows from the gas collision position of at least the lowest stage along a surface of the hot-dip plated steel sheet, and a first control device that controls an ejection flow velocity of the preliminary cooling gas that is sprayed to the gas collision position of at least the lowest stage on the basis of a temperature detection result obtained from the temperature sensor and a flow velocity detection result that is obtained from the first flow velocity sensor.

In this case, when the temperature detection result obtained from the temperature sensor is defined as T (° C.), the flow velocity detection result obtained from the first flow velocity sensor is defined as Vd (m/s), and a limit descending flow velocity, at which a wrinkle occurs on the surface of the hot-dip plated steel sheet, is defined as a wrinkle occurrence limit descending flow velocity VL1 (m/s), the first control device may control the ejection flow velocity of the preliminary cooling gas that is sprayed to the gas collision position of the lowest stage in order for the following Expression (3) and Expression (4) to be satisfied with respect to the gas collision position of at least the lowest stage.

$$VL1=A\cdot(T-C)^2+B\cdot(T-C)-D \quad (3)$$

$$|Vd|\leq|VL1| \quad (4)$$

(in Expression (3), A, B, C, and D represent integer)

(4) In the cooling device for a hot-dip plated steel sheet according to (3), when a solidification initiation temperature of the hot-dip plated steel sheet is defined as Ts (° C.), the first control device may perform a control of the ejection flow velocity in a case where the temperature detection result T (° C.) obtained from the temperature sensor satisfies the following Conditional Expression (5).

$$Ts-49\leq T\leq Ts+9 \quad (5)$$

(5) In the cooling device for a hot-dip plated steel sheet according to (1) or (2), the preliminary cooling device may include a second flow velocity sensor that detects a flow velocity of a gas stream that flows from the gas collision position of at least the lowest stage in an upward direction along a surface of the hot-dip plated steel sheet, and a second control device that controls an ejection flow velocity of the preliminary cooling gas that is sprayed to the gas collision position of at least the lowest stage on the basis of a flow velocity detection result obtained from the second flow velocity sensor.

In this case, when the flow velocity detection result obtained from the second flow velocity sensor is defined as Vu (m/s), and a limit ascending flow velocity, at which a wrinkle occurs on a surface of the hot-dip plated steel sheet, is defined as a wrinkle occurrence limit ascending flow velocity VL2 (m/s), the second control device may control the ejection flow velocity of the preliminary cooling gas that is sprayed to the gas collision position of the lowest stage in order for the following Conditional Expression (6) to be satisfied with respect to the gas collision position of at least the lowest stage.

$$|Vu|\leq|VL2| \quad (6)$$

(6) In the cooling device for a hot-dip plated steel sheet according to any one of (1) to (5), the preliminary cooling device may include a plurality of preliminary cooling nozzles that are individually independent.

(7) In the cooling device for a hot-dip plated steel sheet according to (6), the preliminary cooling device may be provided with a gap, through which the preliminary cooling gas that is used in cooling of the hot-dip plated steel sheet is discharged, between the preliminary cooling nozzles adjacent to each other.

(8) In the cooling device for a hot-dip plated steel sheet according to any one of (1) to (5), the main cooling device and the preliminary cooling device may be configured integrally with each other.

Effects of the Invention

According to the aspects, it is possible to limit the occurrence of a wrinkle on a surface of the hot-dip plated steel sheet (a surface of a plated layer) during a process of manufacturing the hot-dip plated steel sheet in which the thickness of a steel sheet that is a base metal is large, and the thickness of the plated layer is large.

EMBODIMENTS OF THE INVENTION

Hereinafter, an embodiment of the invention will be described in detail with reference to the accompanying drawings.

Figure 1A:
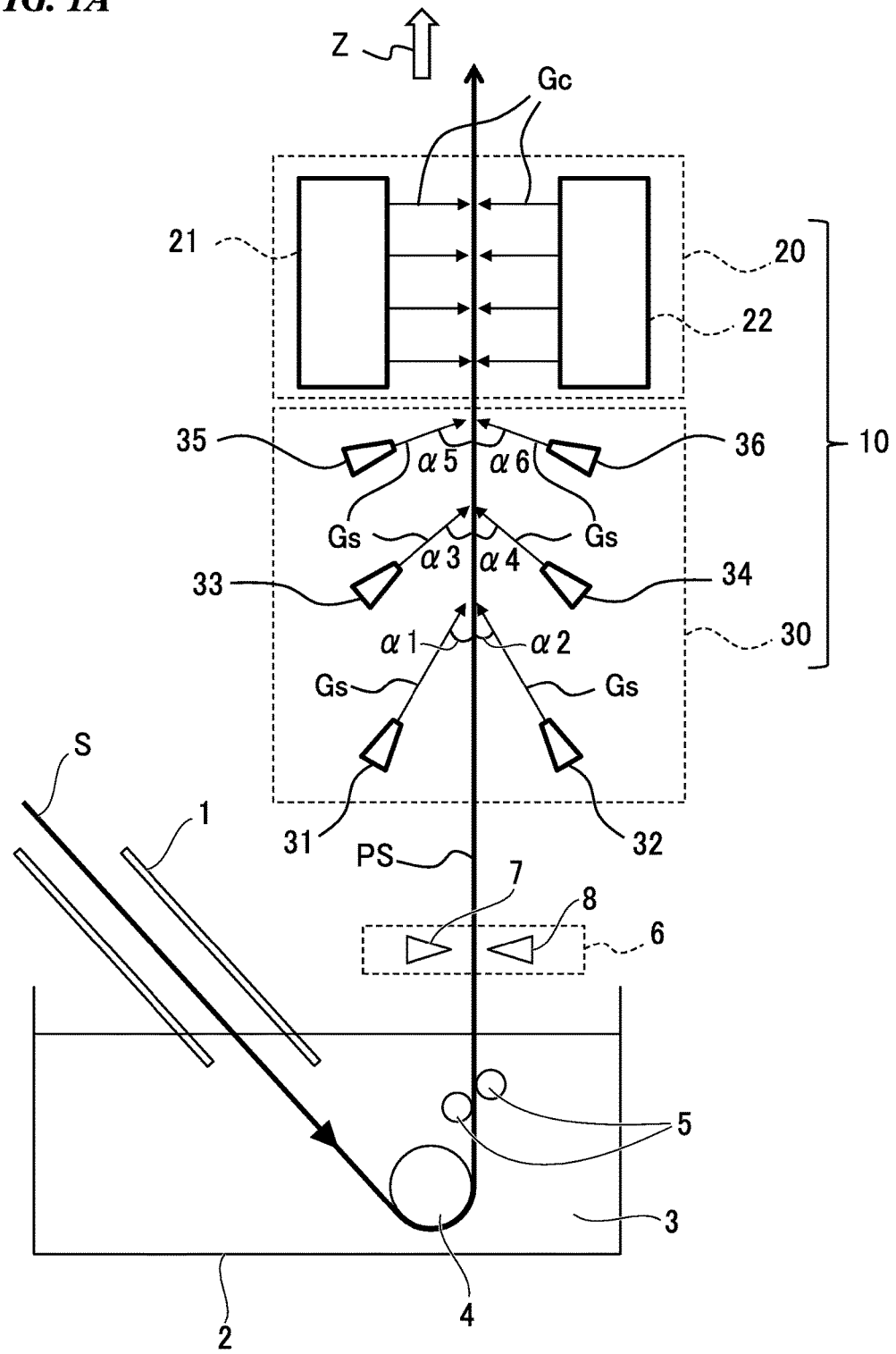
FIG. 1A is a view schematically showing a cooling device 10 for a hot-dip plated steel sheet PS according to an embodiment of the invention (a view when the cooling device 10 is seen from a width direction of the hot-dip plated steel sheet PS).
Figure 1B:
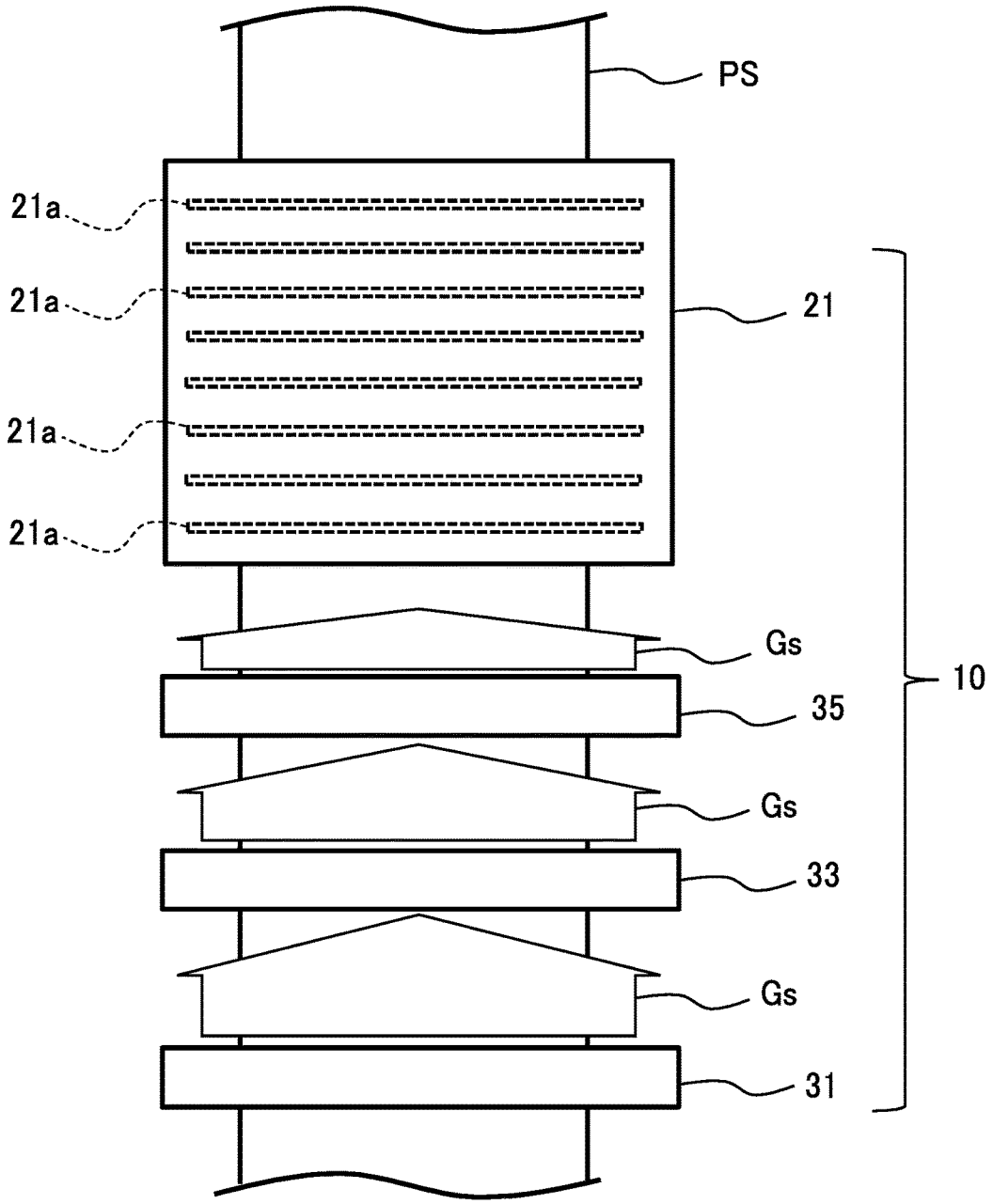
FIG. 1B is a view schematically showing the cooling device 10 for the hot-dip plated steel sheet PS according to the embodiment of the invention (a view when the cooling device 10 is seen from a thickness direction of the hot-dip plated steel sheet PS).

FIG. 1A and FIG. 1B are views schematically showing a cooling device 10 for a hot-dip plated steel sheet PS according to this embodiment. FIG. 1A is a view when the cooling device 10 is seen from a width direction of the hot-dip plated steel sheet PS. FIG. 1B is a view when the cooling device 10 is seen from a thickness direction (a direction perpendicular to a surface of the hot-dip plated steel sheet PS) of the hot-dip plated steel sheet PS.

As shown in FIG. 1A, a steel sheet 5, which is a base metal of the hot-dip plated steel sheet PS, is immersed in a hot-dip plating bath 3 in a hot-dip plating pot 2 through a snout 1. The steel sheet S is pulled up from the hot-dip plating bath 3 through an in-bath folding roll 4 and an in-bath supporting roll 5 which are disposed in the hot-dip plating pot 2, and is conveyed as the hot-dip plated steel sheet PS in which a plated layer is formed on a surface thereof in a vertically upward direction.

In a conveyance route (a conveyance route in which a vertically upward direction is set as a conveyance direction Z) of the hot-dip plated steel sheet PS, a plating thickness control device 6, which controls the thickness of the plated layer of the hot-dip plated steel sheet PS, is disposed at a position on an upper side of the hot-dip plating pot 2. The plating thickness control device 6 includes a pair of wiping nozzles 7 and 8 which are disposed to face each other with the hot-dip plated steel sheet PS interposed therebetween. A wiping gas is sprayed from each of the wiping nozzles 7 and 8 along the thickness direction of the hot-dip plated steel sheet PS, and thus the thickness of the plated layer of the hot-dip plated steel sheet PS is adjusted.

The cooling device 10 is disposed on an upper side of the plating thickness control device 6 in the conveyance route of the hot-dip plated steel sheet PS. The cooling device 10 includes a main cooling device 20 and a preliminary cooling device 30. The main cooling device 20 includes a pair of main cooling gas spraying devices 21 and 22 which are disposed to face each other with the hot-dip plated steel sheet PS interposed therebetween.

The main cooling device 20 corresponds to the cooling device 100 of the related art, and mainly plays a role of compulsorily and rapidly cooling the hot-dip plated steel sheet PS to suppress generation of an alloy layer that causes peeling-off the plated layer. That is, the main cooling gas spraying device 21 vertically sprays a main cooling gas Gc to one surface (front surface) of the hot-dip plated steel sheet PS. The main cooling gas spraying device 22 vertically sprays the main cooling gas Gc to the other surface (rear surface) of the hot-dip plated steel sheet PS.

Furthermore, when the main cooling gas Gc is sprayed from the main cooling gas spraying device 21 and the main cooling gas spraying device 22, as is the case with the cooling device 100 of the related art, a descending gas stream Gd, which descends along both surfaces of the hot-dip plated steel sheet PS from an inlet of the main cooling device 20, occurs.

As shown in FIG. 1B, a plurality of slit nozzles 21*a*, which extend along the width direction of the hot-dip plated steel sheet PS, are provided on a surface, which faces the front surface of the hot-dip plated steel sheet PS, between surfaces of the main cooling gas spraying device 21. The main cooling gas Gc is vertically sprayed to the front surface of the hot-dip plated steel sheet PS from the slit nozzles 21*a*, and thus the main cooling gas Gc is uniformly sprayed to the entirety of the front surface of the hot-dip plated steel sheet PS.

Furthermore, although not shown in FIG. 1B, a plurality of slit nozzles, which extend along the width direction of the hot-dip plated steel sheet PS, are also formed on a surface, which faces the rear surface of the hot-dip plated steel sheet PS, between the surfaces of the main cooling gas spraying device 22.

In addition, the main cooling gas spraying nozzle, which is provided in the main cooling gas spraying devices 21 and 22, is not limited to the slit nozzles. For example, as the main cooling gas spraying nozzle, a round nozzle and the like may be used instead of the slit nozzles.

The preliminary cooling device 30 is provided in a section (preliminary cooling section) between the main cooling device 20 and the plating thickness control device 6 in the conveyance route of the hot-dip plated steel sheet PS, and plays a role of suppressing occurrence of a wrinkle W in the hot-dip plated steel sheet PS mainly in the preliminary cooling section. The preliminary cooling device 30 sprays a preliminary cooling gas Gs to a plurality of (in this embodiment, for example, three) gas collision positions P1, P2, and P3, which are set along the preliminary cooling section, in an obliquely upward direction.

More specifically, the preliminary cooling device 30 includes a pair of first preliminary cooling nozzles 31 and 32, a pair of second preliminary cooling nozzles 33 and 34, and a pair of third preliminary cooling nozzles 35 and 36. The preliminary cooling nozzles are independent nozzles in which a nozzle position, a spraying direction of the preliminary cooling gas Gs, and an ejection flow velocity (ejection air flow rate) of the preliminary cooling gas Gs can be individually adjusted.

The first preliminary cooling nozzle 31 is disposed on a front surface side of the hot-dip plated steel sheet PS, and sprays the preliminary cooling gas Gs to the gas collision position P1 from the front surface side of the hot-dip plated steel sheet PS in an obliquely upward direction. The first preliminary cooling nozzle 32 is disposed on a rear surface side of the hot-dip plated steel sheet PS, and sprays the preliminary cooling gas Gs to the gas collision position P1 from the rear surface side of the hot-dip plated steel sheet PS in an obliquely upward direction.

As shown in FIG. 1B, the first preliminary cooling nozzles 31 and 32 are configured to extend along the width direction of the hot-dip plated steel sheet PS. That is, the preliminary cooling gas Gs, which are sprayed form the first preliminary cooling nozzles 31 and 32, are uniformly sprayed along the width direction of the hot-dip plated steel sheet PS.

As shown in FIG. 1A, an angle, which is made by a spraying direction of the preliminary cooling gas Gs that is sprayed from the first preliminary cooling nozzle 31, and the conveyance direction Z of the hot-dip plated steel sheet PS, is defined as an angle $\alpha 1$. In addition, an angle, which is made by the spraying direction of the preliminary cooling gas Gs that is sprayed from the first preliminary cooling nozzle 32, and the conveyance direction Z of the hot-dip plated steel sheet PS, is defined as $\alpha 2$. The angle $\alpha 1$ made by the first preliminary cooling nozzle 31 and the angle $\alpha 2$ made by the first preliminary cooling nozzle 32 are set to the same value.

Furthermore, a position of the first preliminary cooling nozzle 31 and a position of the first preliminary cooling nozzle 32 in the conveyance direction Z are the same as each other. That is, the first preliminary cooling nozzles 31 and 32 are provided at the same height position.

The second preliminary cooling nozzle 33 is disposed on an upper side of the first preliminary cooling nozzle 31 on the front surface side of the hot-dip plated steel sheet PS, and sprays the preliminary cooling gas Gs to the gas collision position P2 from the front surface side of the hot-dip plated steel sheet PS in an obliquely upward direction. The second preliminary cooling nozzle 34 is disposed on an upper side of the first preliminary cooling nozzle 32 on the rear surface side of the hot-dip plated steel sheet PS, and sprays the preliminary cooling gas Gs to the gas collision position P2 from the rear surface side of the hot-dip plated steel sheet PS in an obliquely upward direction.

As shown in FIG. 1B, the second preliminary cooling nozzles 33 and 34 are configured to extend along the width direction of the hot-dip plated steel sheet PS. That is, the preliminary cooling gas Gs, which is sprayed from the second preliminary cooling nozzles 33 and 34, are uniformly sprayed along the width direction of the hot-dip plated steel sheet PS.

As shown in FIG. 1A, an angle, which is made by a spraying direction of the preliminary cooling gas Gs that is sprayed from the second preliminary cooling nozzle 33, and the conveyance direction Z of the hot-dip plated steel sheet PS, is defined as an angle $\alpha 3$. In addition, an angle, which is made by the spraying direction of the preliminary cooling gas Gs that is sprayed from the second preliminary cooling nozzle 34, and the conveyance direction Z of the hot-dip plated steel sheet PS, is defined as $\alpha 4$. The angle $\alpha 3$ made by the second preliminary cooling nozzle 33 and the angle $\alpha 4$ made by the second preliminary cooling nozzle 34 are set to the same value.

Furthermore, a position of the second preliminary cooling nozzle 33 and a position of the second preliminary cooling nozzle 34 in the conveyance direction Z are the same as each other. That is, the second preliminary cooling nozzles 33 and 34 are provided at the same height position.

The third preliminary cooling nozzle 35 is disposed on an upper side of the second preliminary cooling nozzle 33 on the front surface side of the hot-dip plated steel sheet PS, and sprays the preliminary cooling gas Gs to the gas collision position P3 from the front surface side of the hot-dip plated steel sheet PS in an obliquely upward direction. The third preliminary cooling nozzle 36 is disposed on an upper side of the second preliminary cooling nozzle 34 on the rear surface side of the hot-dip plated steel sheet PS, and sprays the preliminary cooling gas Gs to the gas collision position P3 from the rear surface side of the hot-dip plated steel sheet PS in an obliquely upward direction.

As shown in FIG. 1B, the third preliminary cooling nozzles 35 and 36 are configured to extend along the width direction of the hot-dip plated steel sheet PS. That is, the preliminary cooling gas Gs, which is sprayed from the third preliminary cooling nozzles 35 and 36, are uniformly sprayed along the width direction of the hot-dip plated steel sheet PS.

As shown in FIG. 1A, an angle, which is made by a spraying direction of the preliminary cooling gas Gs that is sprayed from the third preliminary cooling nozzle 35, and the conveyance direction Z of the hot-dip plated steel sheet PS, is defined as an angle $\alpha 5$. In addition, an angle, which is made by the spraying direction of the preliminary cooling gas Gs that is sprayed from the third preliminary cooling nozzle 36, and the conveyance direction Z of the hot-dip plated steel sheet PS, is defined as $\alpha 6$. The angle $\alpha 5$ made by the third preliminary cooling nozzle 35 and the angle $\alpha 6$ made by the third preliminary cooling nozzle 36 are set to the same value.

Furthermore, a position of the third preliminary cooling nozzle 35 and a position of the third preliminary cooling nozzle 36 in the conveyance direction Z are the same as each other. That is, the third preliminary cooling nozzles 35 and 36 are provided at the same height position.

In the preliminary cooling device 30, the closer the gas collision position is to a lower stage of the preliminary cooling section, the smaller the angle, which is made by the spraying direction of the preliminary cooling gas Gs and the conveyance direction Z of the hot-dip plated steel sheet PS, becomes. That is, the angles $\alpha 1$, $\alpha 3$, and $\alpha 5$ are set to satisfy the following Relational Expression (1). In addition, the angles $\alpha 2$, $\alpha 4$, and $\alpha 6$ are set to satisfy the following Relational Expression (2).

$$\alpha 5 > \alpha 3 > \alpha 1 \quad (1)$$

$$\alpha 6 > \alpha 4 > \alpha 2 \quad (2)$$

(here, $\alpha 1 = \alpha 2$, $\alpha 3 = \alpha 4$, and $\alpha 5 = \alpha 6$)

As described above, the preliminary cooling device 30 may be provided with a gap, through which the preliminary cooling gas Gs that is used in cooling of the hot-dip plated steel sheet PS is discharged, between the preliminary cooling nozzles adjacent to each other.

Figure 2:
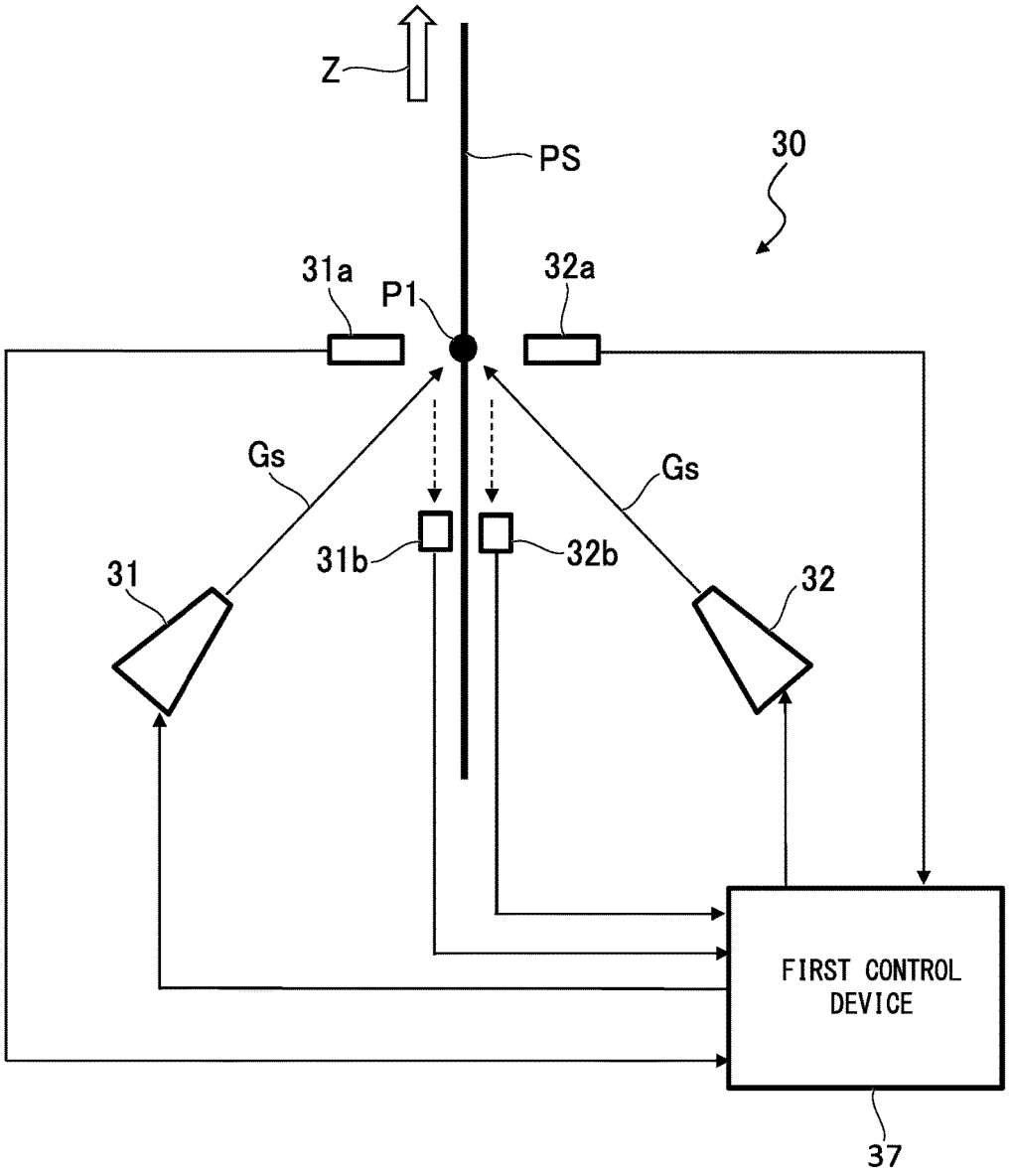
FIG. 2 is an enlarged view of the periphery of a gas collision position P1 of the lowest stage in a preliminary cooling section.

FIG. 2 is an enlarged view of the periphery of the gas collision position P1 of the lowest stage in the preliminary cooling section. As shown in FIG. 2, the preliminary cooling device 30 in this embodiment further includes temperature sensors 31*a* and 32*a*, first flow velocity sensors 31*b* and 32*b*, and a first control device 37.

The temperature sensor 31*a* detects a surface temperature of the hot-dip plated steel sheet PS on the front surface side at the gas collision position P1 of the lowest stage, and outputs a signal indicating the temperature detection result to the first control device 37. The temperature sensor 32*a* detects the surface temperature of the hot-dip plated steel sheet PS on the rear surface side at the gas collision position P1 of the lowest stage, and outputs a signal indicating the temperature detection result to the first control device 37.

The first flow velocity sensor 31*b* detects a flow velocity of a gas stream that downwardly flows from the gas collision position P1 of the lowest stage along a surface (front surface) of the hot-dip plated steel sheet PS, and outputs a signal indicating the flow velocity detection result to the first control device 37. The first flow velocity sensor 32*b* detects a flow velocity of a gas stream that downwardly flows from the gas collision position P1 of the lowest stage along a surface (rear surface) of the hot-dip plated steel sheet PS, and outputs a signal indicating the flow velocity detection result to the first control device 37.

The first control device 37 controls an ejection flow velocity of the preliminary cooling gas Gs that is sprayed from each of the first preliminary cooling nozzles 31 and 32 to the gas collision position P1 of the lowest stage on the basis of the temperature detection results obtained from the temperature sensors 31*a* and 32*a*, and the flow velocity detection results obtained from the first flow velocity sensors 31*b* and 32*b*. Furthermore, a detailed operation of the first control device 37 will be described later.

Hereinafter, a description will be provided of an operational effect of the cooling device 10 according to this embodiment.

As described above, when the thickness of the steel sheet S that is a base metal increases, and the thickness of the plated layer also increases (when an adhered amount of plating increases), an oxide film on the surface of the plated layer may run down from the vicinity of the center in the width direction of the hot-dip plated steel sheet PS due to its own weight.

Figure 3A:
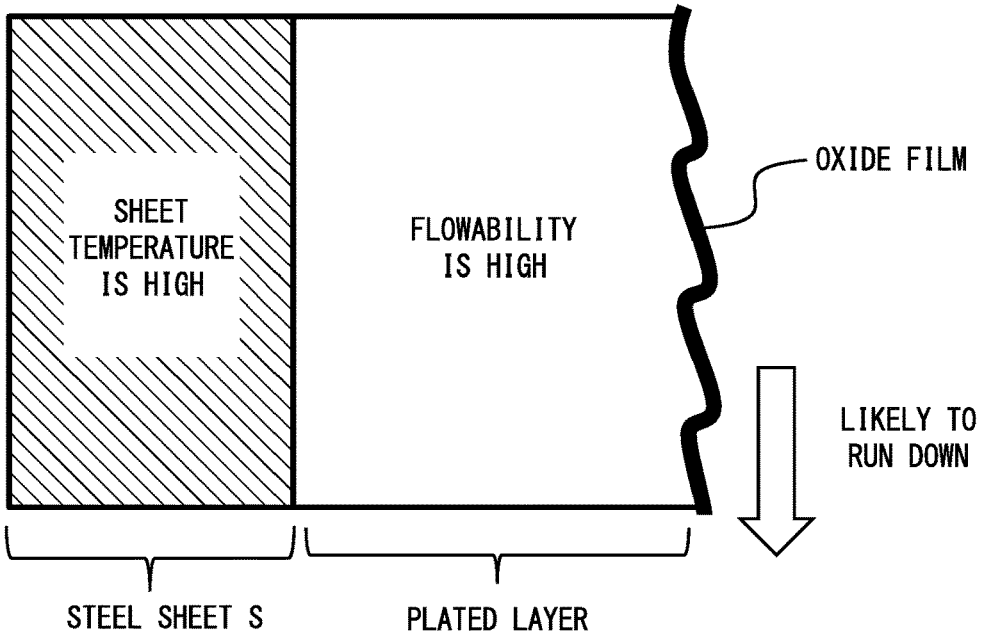
FIG. 3A is a schematic view showing an aspect in which an oxide film of a plated layer is likely to run down in a case where a sheet temperature is high (a case where the flowability of the plated layer is high).
Figure 3B:
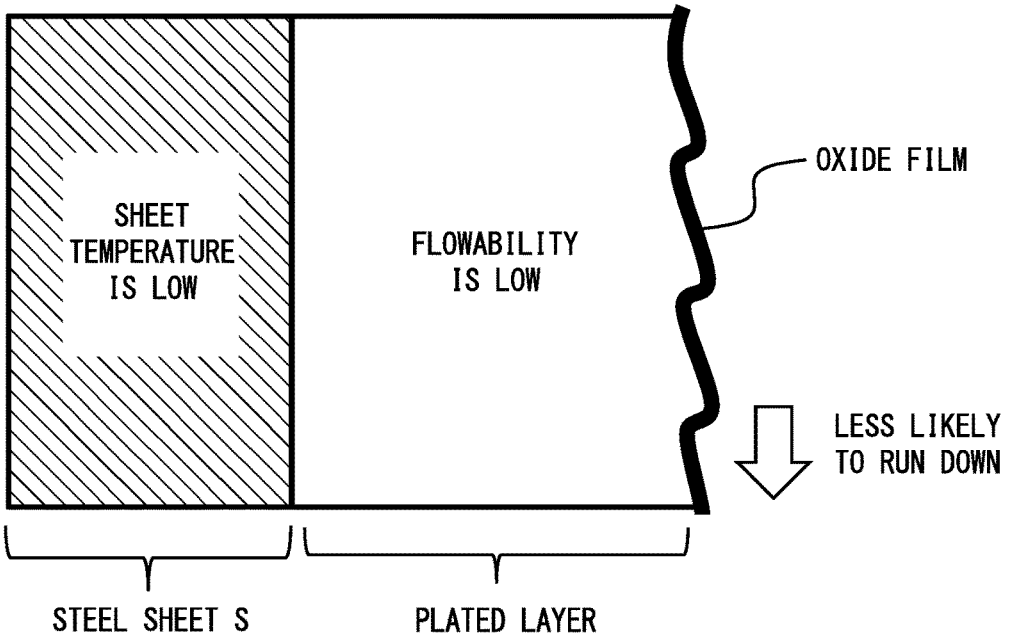
FIG. 3B is a schematic view showing an aspect in which the oxide film of the plated layer is less likely to run down in a case where the sheet temperature is low (a case where the flowability of the plated layer is low).

As shown in FIG. 3A, it is considered that the running down of the oxide film is likely to occur particularly at an initial stage of solidification of the plated layer, that is, at a state in which the flowability of the plated layer is high due to a high sheet temperature (that is, sheet temperature of the steel sheet S) of the hot-dip plated steel sheet PS immediately after the hot-dip plated steel sheet PS is pulled up from the plating bath. In the stage in which the flowability of the plated layer is high, it is considered that the running down of the oxide film is also likely to be enlarged due to the descending gas stream Gd that is sprayed from the inlet of the main cooling device 20. On the other hand, as shown in FIG. 3B, when the sheet temperature of the hot-dip plated steel sheet PS is lowered, and solidification of the plated layer is in progress, and thus the flowability of the plated layer decreases, it is considered that the running down of the oxide film is less likely to occur.

Accordingly, it is considered that as a countermeasure of limiting the occurrence of the wrinkle W caused by the running down of the oxide film, it is effective to preliminary cool down (to promote solidification of the plated layer) the hot-dip plated steel sheet PS while suppressing the descending gas stream Gd that is sprayed from the inlet of the main cooling device 20 in the conveyance route (that is, the preliminary cooling section) between the plating thickness control device 6 and the main cooling device 20.

The present inventors have investigated a relationship between the sheet temperature before cooling and a wrinkle occurrence limit flow velocity at which the wrinkle W occurs on the surface of the hot-dip plated steel sheet PS by using the cooling device 100 of the related art so as to verify effectiveness of the above-described countermeasure. Here, the sheet temperature before cooling represents a temperature of the hot-dip plated steel sheet PS that is measured on an immediately lower side (inlet side of the cooling device 100) of the cooling device 100. Furthermore, the wrinkle occurrence limit flow velocity represents a flow velocity (maximum flow velocity at which the wrinkle W occurs), which is measured on an immediately lower side of the cooling device 100, of a gas that flows along the surface of the hot-dip plated steel sheet PS. Furthermore, in the investigation of the above-described relationship, the adhered amount of plating is set to 150 g/m$^2$ per single surface so as to make the plated layer of the hot-dip plated steel sheet PS thick.

Figure 4:
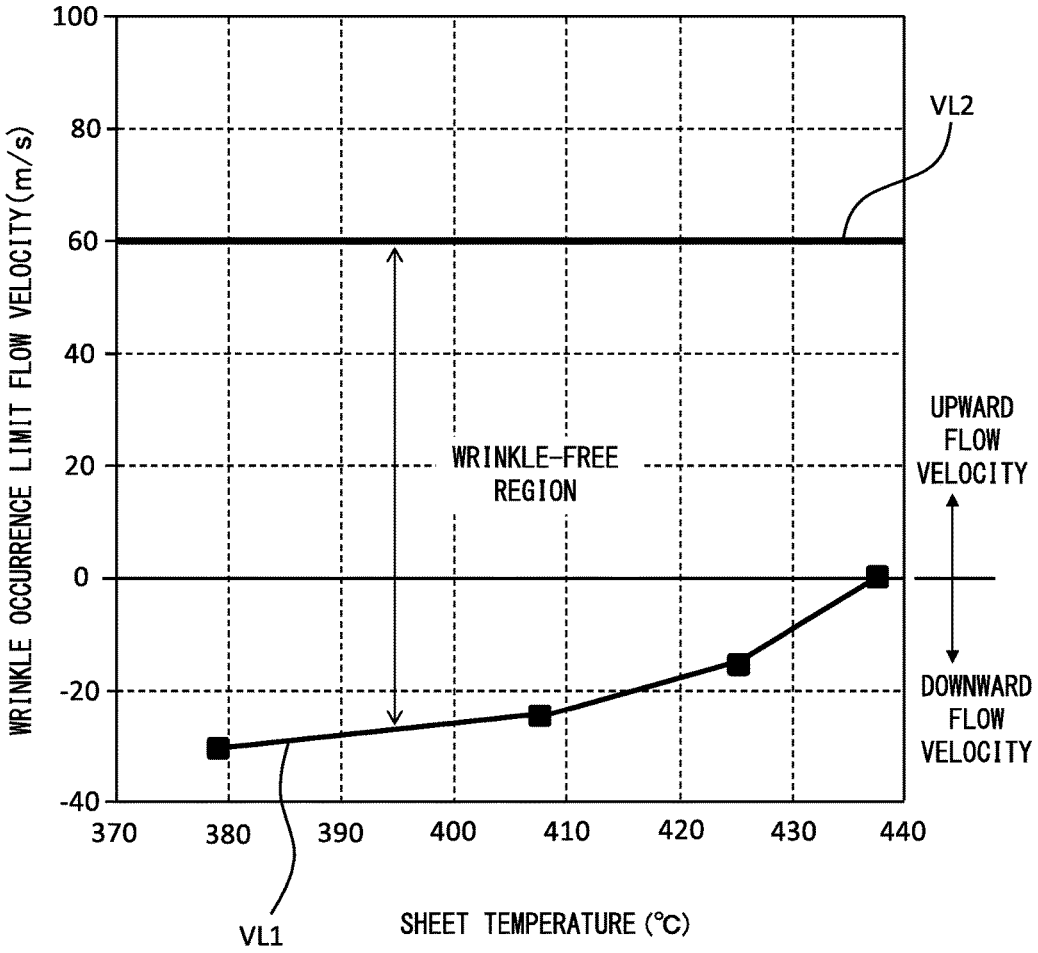
FIG. 4 is a view showing a relationship between a sheet temperature before being cooled down and a wrinkle occurrence limit flow velocity on a surface of the hot-dip plated steel sheet PS.

As shown in FIG. 4, in a case where an upward gas stream occurs on the surface of the hot-dip plated steel sheet PS on an immediately lower side of the cooling device 100, if a flow velocity thereof is equal to or lower than a predetermined velocity (limit ascending flow velocity: in FIG. 4, approximately 60 m/s), the wrinkle W does not occur regardless of the sheet temperature. Hereinafter, the limit ascending flow velocity (60 m/s shown in FIG. 4), at which the wrinkle W occurs on the surface of the hot-dip plated steel sheet PS, is defined as a wrinkle occurrence limit ascending flow velocity VL2 (m/s). On the other hand, in a case where a downward gas stream (corresponding to the descending gas stream Gd) occurs on the surface of the hot-dip plated steel sheet PS on an immediately lower side of the cooling device 100, the higher the sheet temperature is, the more the wrinkle W is likely to occur at a flow velocity (limit descending flow velocity) lower than the flow velocity that of the upward gas stream. Hereinafter, the limit descending flow velocity, at which the wrinkle W occurs on the surface of the hot-dip plated steel sheet PS, is defined as a wrinkle occurrence limit descending flow velocity VL1 (m/s).

Furthermore, when the wrinkle occurrence limit descending flow velocity VL1 shown in FIG. 4 is approximated by a regression formula, the wrinkle occurrence limit descending flow velocity VL1 can be expressed by the following Expression (3) that is a quadratic function of the sheet temperature T. In the following Expression (3), A, B, C, and D are integers.

$$VL1=A\cdot(T-C)^2+B\cdot(T-C)-D \quad (3)$$

From the above-described investigation, it can be seen that the higher the sheet temperature is high, that is, the higher the flowability of the plated layer is, the more the running down of the oxide film is likely to occur even when the flow velocity of the downward gas stream is low. The reason for this is considered as follow. That is, the higher the flowability of the plated layer is, the more the running down of the oxide film is likely to occur due to own weight of the oxide film. Accordingly, as the sheet temperature is high, it is necessary to further limit the downward gas stream so as to limit the running down of the oxide film.

The effectiveness of the above-described countermeasure is confirmed from the above-described investigation result.

As a countermeasure for suppressing occurrence of the wrinkle W caused by the running down of the oxide film, the present inventors have found the following two countermeasures on the basis of the above-described investigation result.

(Countermeasure 1) The preliminary cooling gas is sprayed to a plurality of gas collision positions, which are set along a conveyance route (preliminary cooling section) between the plating thickness control device 6 and the main cooling device 20, in an obliquely upward direction.

(Countermeasure 2) The closer the gas collision positions are to a lower stage of the preliminary cooling section (that is, the higher the sheet temperature is), the further an angle, which is made by the spraying direction of the preliminary cooling gas Gs and the conveyance direction Z of the hot-dip plated steel sheet PS, is set to be small.

When employing the countermeasure 1, it is possible to preliminary cools down the hot-dip plated steel sheet PS (to promote solidification of the plated layer) while suppressing the descending gas stream Gd sprayed from the inlet of the main cooling device 20. In addition, when employing the countermeasure 2, the higher the sheet temperature is (that is, the higher the flowability of the plated layer is), the further it is possible to limit the descending gas stream Gd. When the angle, which is made by the spraying direction of the preliminary cooling gas Gs and the conveyance direction Z of the hot-dip plated steel sheet PS is set to be small, an effect of supporting the oxide film by the preliminary cooling gas Gs from an obliquely downward side is also obtained, and thus it is possible to further effectively limit the running down of the oxide film.

The cooling device 10 according to this embodiment includes the preliminary cooling device 30 for realization of the above-described countermeasures 1 and 2. That is, the preliminary cooling device 30 includes three preliminary cooling nozzles (the first preliminary cooling nozzle 31, the second preliminary cooling nozzle 33, and the third preliminary cooling nozzle 35) configured to spray the preliminary cooling gas Gs to the three gas collision positions P1, P2, and P3, which are set along the preliminary cooling section, from the front surface side of the hot-dip plated steel sheet PS in an obliquely upward direction, and three preliminary cooling nozzles (the first preliminary cooling nozzle 32, the second preliminary cooling nozzle 34, and the third preliminary cooling nozzle 36) configured to spray the preliminary cooling gas Gs to the gas collision positions P1, P2, and P3 from the rear surface side of the hot-dip plated steel sheet PS in an obliquely upward direction.

In addition, in the preliminary cooling device 30, the closer the gas collision positions are to the lower stage of the preliminary cooling sections, the smaller an angle, which is made by the spraying direction of the preliminary cooling gas Gs and the conveyance direction Z of the hot-dip plated steel sheet PS, becomes. That is, the angle $\alpha 1$ made by the first preliminary cooling nozzle 31, the angle $\alpha 3$ made by the second preliminary cooling nozzle 33, and the angle $\alpha 5$ made by the third preliminary cooling nozzle 35 are set to satisfy the following Relational Expression (1). In addition, the angle $\alpha 2$ made by the first preliminary cooling nozzle 32, the angle $\alpha 4$ made by the second preliminary cooling nozzle 34, and the angle $\alpha 6$ made by the third preliminary cooling nozzle 36 are set to satisfy the following Relational Expression (2).

$$\alpha 5>\alpha 3>\alpha 1 \quad (1)$$

$$\alpha 6>\alpha 4>\alpha 2 \quad (2)$$

(here, $\alpha 1=\alpha 2$, $\alpha 3=\alpha 4$, and $\alpha 5=\alpha 6$)

According to the configuration of the preliminary cooling device 30 for realization of the above-described countermeasures 1 and 2, even in a case where the steel sheet S that is a base metal, and the plated layer are thick, it is possible to limit the running down of the oxide film on the surface of the plated layer over the entirety of the preliminary cooling section ranging from the plating thickness control device 6 to the main cooling device 20. As a result, according to the cooling device 10 according to the embodiment, in a process of manufacturing the hot-dip plated steel sheet PS in which the thickness of the steel sheet S that is a base metal is thick, and the thickness of the plated layer is thick, it is possible to limit the occurrence of the wrinkle W on the surface (surface of the plated layer) of the hot-dip plated steel sheet PS.

Here, in this embodiment, the temperature detection result (surface temperature of the hot-dip plated steel sheet PS on the front surface side at the gas collision position P1 of the lowest stage) obtained from the temperature sensor 31*a* is defined as T (° C.). In addition, the flow velocity detection result (flow velocity of a gas stream that downwardly flows from the gas collision position P1 of the lowest stage along the surface (front surface) of the hot-dip plated steel sheet PS) obtained from the first flow velocity sensor 31*b* is defined as Vd (m/s). In addition, as described above, the limit descending flow velocity, at which the wrinkle W occurs on the surface of the hot-dip plated steel sheet PS, is defined as the wrinkle occurrence limit descending flow velocity VL1 (m/s).

The first control device 37 of the preliminary cooling device 30 in this embodiment controls the ejection flow velocity of the preliminary cooling gas Gs that is sprayed to the gas collision position P1 from the first preliminary cooling nozzle 31 on the basis of the temperature detection result T obtained from the temperature sensor 31*a* and the flow velocity detection result Vd obtained from the first flow velocity sensor 31*b* in order for the following Expressions (3) and (4) to be satisfied with respect to the gas collision position P1 of the lowest stage.

$$VL1=A\cdot(T-C)^2+B\cdot(T-C)-D \quad (3)$$

$$|Vd|\leq|VL1| \quad (4)$$

In addition, when the solidification initiation temperature of the hot-dip plated steel sheet PS is defined as Ts (° C.), in a case where the temperature detection result T obtained from the temperature sensor 31*a* satisfies the following Conditional Expression (5), the first control device 37 performs the above-described ejection flow velocity control. The reason for this is because Expression (3) indicating the wrinkle occurrence limit descending flow velocity VL1 is established only in a temperature range expressed by the following Conditional Expression (5).

$$Ts-49\leq T\leq Ts+9 \quad (5)$$

According to the ejection flow velocity control of the preliminary cooling gas Gs as described above, the flow velocity Vd of the gas stream that downwardly flows from the gas collision position P1 along the surface (front surface) of the hot-dip plated steel sheet PS is lower than the wrinkle occurrence limit descending flow velocity VL1 regardless of the sheet temperature T. As a result, it is possible to reduce the occurrence of the wrinkle W on the surface (front surface) of the hot-dip plated steel sheet PS (refer to FIG. 4).

Similarly, in a case where the temperature detection result T obtained from the temperature sensor 32*a* satisfies Conditional Expression (5), the first control device 37 controls the ejection flow velocity of the preliminary cooling gas Gs that is sprayed to the gas collision position P1 from the first preliminary cooling nozzle 32 on the basis of the temperature detection result T obtained from the temperature sensor 32*a* and the flow velocity detection result Vd obtained from the first flow velocity sensor 32*b* in order for Expressions (3) and (4) to be satisfied with respect to the gas collision position P1 of the lowest stage.

According to this, the flow velocity Vd of the gas stream that downwardly flows from the gas collision position P1 along the surface (rear surface) of the hot-dip plated steel sheet PS is lower than the wrinkle occurrence limit descending flow velocity VL1 regardless of the sheet temperature T. As a result, it is possible to limit the occurrence of the wrinkle W on the surface (rear surface) of the hot-dip plated steel sheet PS.

Furthermore, in the invention, the following modification examples can be made without limitation to the above-described embodiment.

(1) In the above-described embodiment, description has been given of a case where the surface temperature of the hot-dip plated steel sheet PS at the gas collision position P1 of the lowest stage, and the flow velocity of the gas stream that downwardly flows from the gas collision position P1 of the lowest stage along the surface of the hot-dip plated steel sheet PS are detected, and the ejection flow velocity of the preliminary cooling gas Gs sprayed to the gas collision position P1 of the lowest stage is controlled on the basis of the detection results.

The ejection flow velocity of the preliminary cooling gas Gs may be controlled in order for Expressions (3) and (4) to be satisfied with respect to the two gas collision positions P1 and P2, or in order for Expressions (3) and (4) to be satisfied with respect to the entirety of the gas collision positions P1, P2, and P3 without limitation to the case. That is, the ejection flow velocity of the preliminary cooling gas Gs may be controlled in order for Expressions (3) and (4) to be satisfied with respect to at least the gas collision position P1 of the lowest stage.

(2) In the above-described embodiment, description has been given of a case where the surface temperature of the hot-dip plated steel sheet PS at the gas collision position P1 of the lowest stage, and the flow velocity of the gas stream that downwardly flows from the gas collision position P1 of the lowest stage along the surface of the hot-dip plated steel sheet PS are detected, and the ejection flow velocity of the preliminary cooling gas Gs, which is sprayed to the gas collision position P1 of the lowest stage, is controlled on the basis of the detection results in order for the Expressions (3) and (4) to be satisfied.

Figure 5:
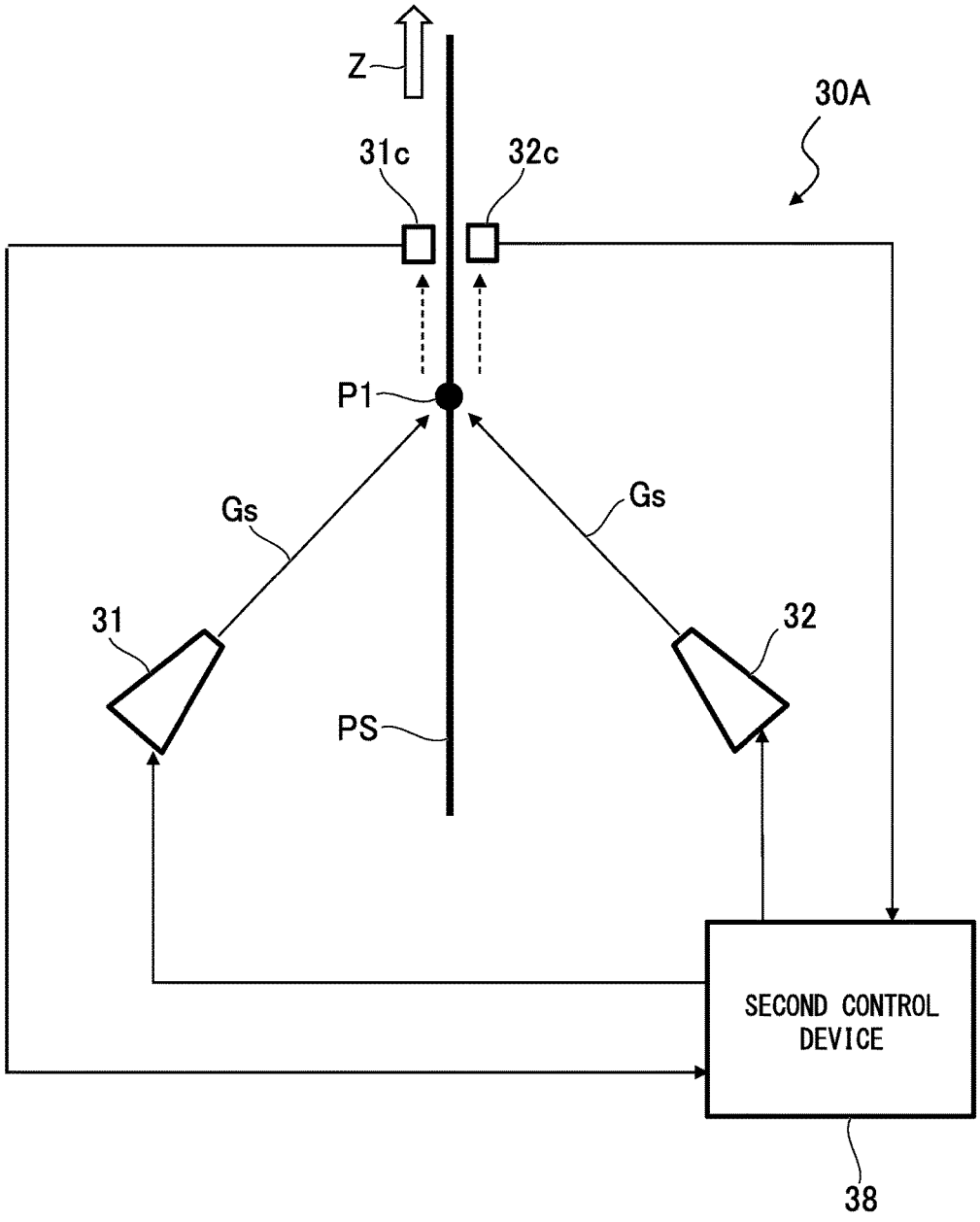
FIG. 5 is a view showing a modification example of this embodiment.

A preliminary cooling device 30A including a configuration as described in FIG. 5 may be employed without limitation to the above-described configuration. As shown in FIG. 5, the preliminary cooling device 30A of this modification example further includes second flow velocity sensors 31*c* and 32*c*, and a second control device 38 in addition to the first preliminary cooling nozzles 31 and 32 (not shown), the second preliminary cooling nozzles 33 and 34 (not shown), and the third preliminary cooling nozzles 35 and 36.

The second flow velocity sensor 31*c* detects a flow velocity of a gas stream that upwardly flows from the gas collision position P1 of the lowest stage along the surface (front surface) of the hot-dip plated steel sheet PS, and outputs a signal indicating the flow velocity detection result to the second control device 38. The second flow velocity sensor 32*c* detects a flow velocity of a gas stream that upwardly flows from the gas collision position P1 of the lowest stage along the surface (rear surface) of the hot-dip plated steel sheet PS, and outputs a signal indicating the flow velocity detection result to the second control device 38.

The second control device 38 controls the ejection flow velocity of the preliminary cooling gas Gs that is sprayed to the gas collision position P1 of the lowest stage on the basis of the flow velocity detection result obtained from the second flow velocity sensors 31*c* and 32*c*.

Here, the flow velocity detection result obtained from the second flow velocity sensor 31*c* is defined as Vu (m/s), and a limit ascending flow velocity, at which the wrinkle W occurs on the surface of the hot-dip plated steel sheet PS, is defined as a wrinkle occurrence limit ascending flow velocity VL2 (m/s). As shown in FIG. 4, for example, the wrinkle occurrence limit ascending flow velocity VL2 is as constant as 60 (m/s).

The second control device 38 controls the ejection flow velocity of the preliminary cooling gas Gs, which is sprayed from the first preliminary cooling nozzle 31 to the gas collision position P1 of the lowest stage, on the basis of the flow velocity detection result Vu obtained from the second flow velocity sensor 31*c* in order for the following Conditional Expression (6) to be satisfied with respect to the gas collision position P1 of the lowest stage.

$$|Vu| \leq |VL2| \tag{6}$$

According to the ejection flow velocity control of the preliminary cooling gas Gs in this modification example as described above, the flow velocity Vu of the gas stream that upwardly flows from the gas collision position P1 along the surface (front surface) of the hot-dip plated steel sheet PS is lower than the wrinkle occurrence limit ascending flow velocity VL2 regardless of the sheet temperature T. As a result, it is possible to limit the occurrence of the wrinkle W on the surface (rear surface) of the hot-dip plated steel sheet PS (refer to FIG. 4).

Similarly, the second control device 38 controls the ejection flow velocity of the preliminary cooling gas Gs that is sprayed to the gas collision position P1 of the lowest stage from the first preliminary cooling nozzle 32 on the basis of the flow velocity detection result Vu obtained from the second flow velocity sensor 32*c* in order for Conditional Expression (6) to be satisfied with respect to the gas collision position P1 of the lowest stage.

According to this, the flow velocity Vu of the gas stream that upwardly flows from the gas collision position P1 along the surface (rear surface) of the hot-dip plated steel sheet PS is lower than the wrinkle occurrence limit ascending flow velocity VL2 regardless of the sheet temperature T. As a result, it is possible to limit the occurrence of the wrinkle W on the surface (rear surface) of the hot-dip plated steel sheet PS.

Furthermore, even in this modification example, the ejection flow velocity of the preliminary cooling gas Gs may be controlled in order for Conditional Expression (6) to be satisfied with respect to the two gas collision positions P1 and P2, or in order for Conditional Expression (6) to be satisfied with respect to the entirety of the gas collision positions P1, P2, and P3. That is, the ejection flow velocity of the preliminary cooling gas Gs may be controlled in order for Conditional Expression (6) to be satisfied with respect to at least the gas collision position P1 of the lowest stage.

(3) In the above-described embodiment, a description has been provided of a case where the three gas collision positions P1 to P3 are set in the preliminary cooling section, and the preliminary cooling device 30 includes three pairs of (a total of six) preliminary cooling nozzles which respectively correspond to the gas collision positions P1 to P3. However, the number of the gas collision positions which are set in the preliminary cooling section may be two or greater without limitation to the embodiment. In addition, the number (total number) of pairs of the preliminary cooling nozzles may be appropriately changed in correspondence with the number of the gas collision positions.

(4) In the above-described embodiment, description has been given of a case where the preliminary cooling device 30 includes the plurality of preliminary cooling nozzles (the first preliminary cooling nozzles 31 and 32, the second preliminary cooling nozzles 33 and 34, and the third preliminary cooling nozzles 35 and 36) which are individually independent. For example, a preliminary cooling device 40 as shown in FIG. 6 may be provided Instead of the preliminary cooling device 30 as described above.

Figure 6:
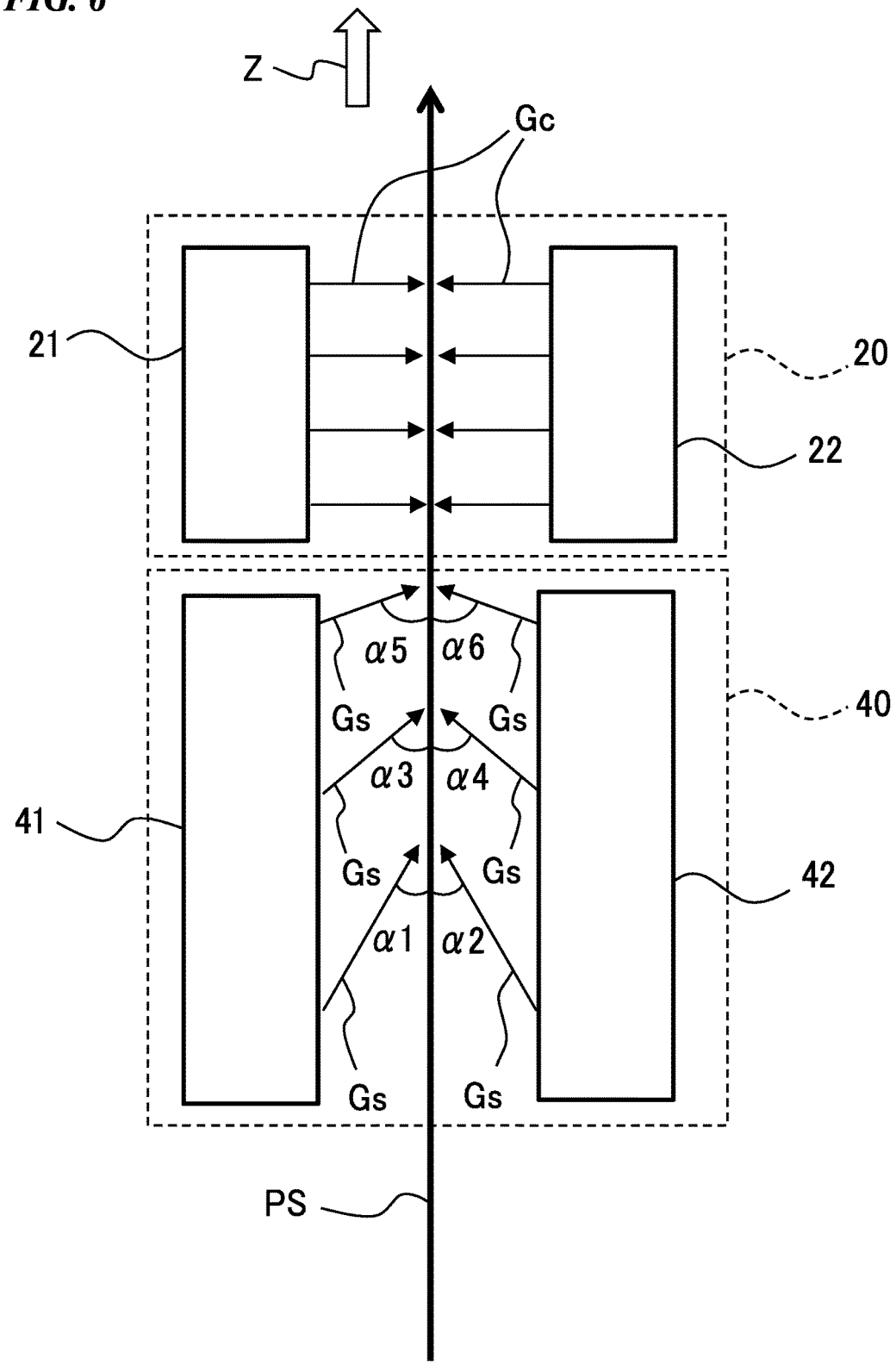
FIG. 6 is a view showing a modification example of this embodiment.

As shown in FIG. 6, the preliminary cooling device 40 includes a preliminary cooling gas spraying device 41 that has a function of the first preliminary cooling nozzle 31, the second preliminary cooling nozzle 33, and the third preliminary cooling nozzle 35, and a preliminary cooling gas spraying device 42 having a function of the first preliminary cooling nozzle 32, the second preliminary cooling nozzle 34, and the third preliminary cooling nozzle 36. That is, it is not necessary to use a plurality of preliminary cooling nozzles which are individually independent similar to the preliminary cooling device 30 as long as the above-described countermeasures 1 and 2 can be realized.

Figure 7:
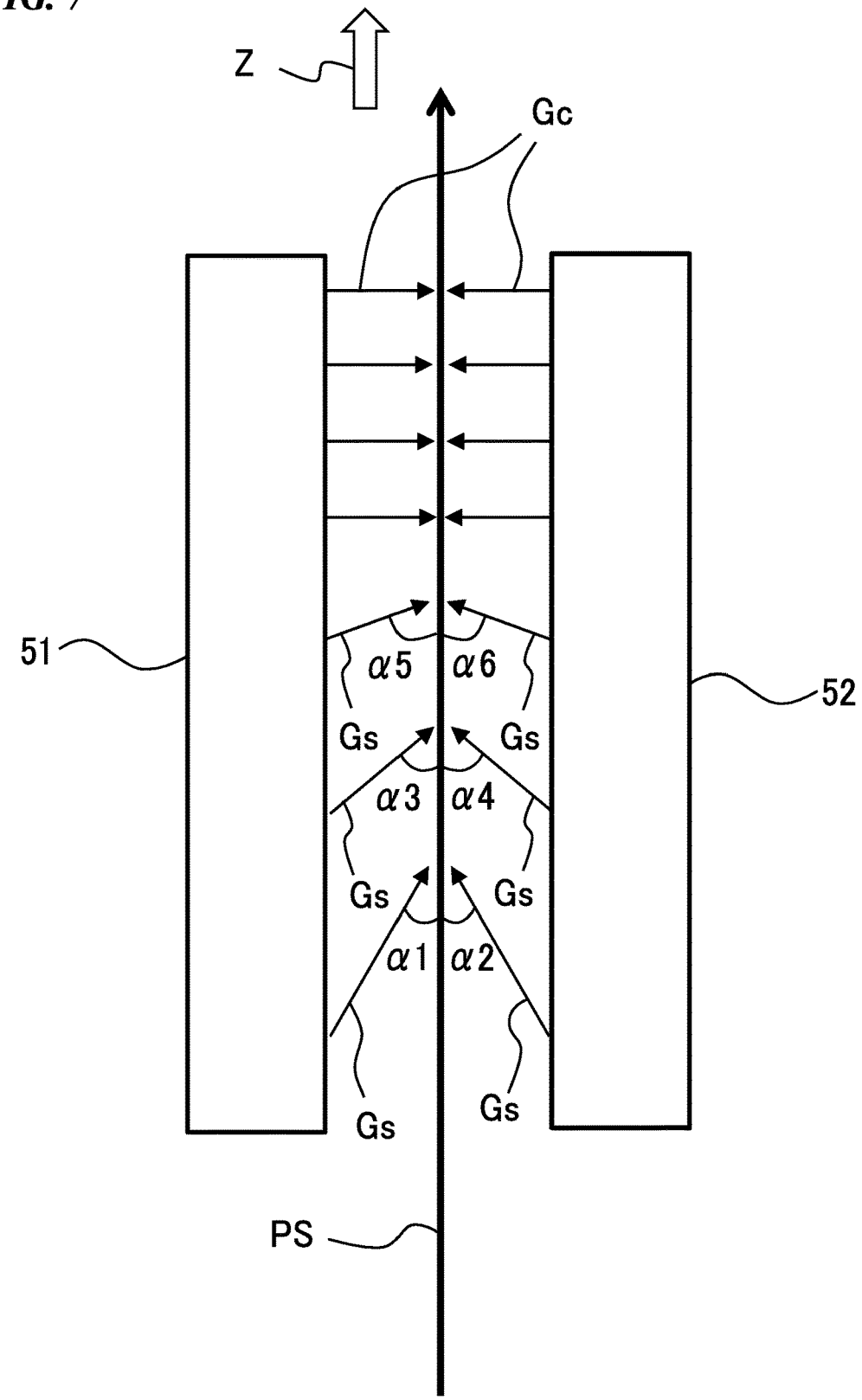
FIG. 7 is a view showing a modification example of this embodiment.
Figure 8A:
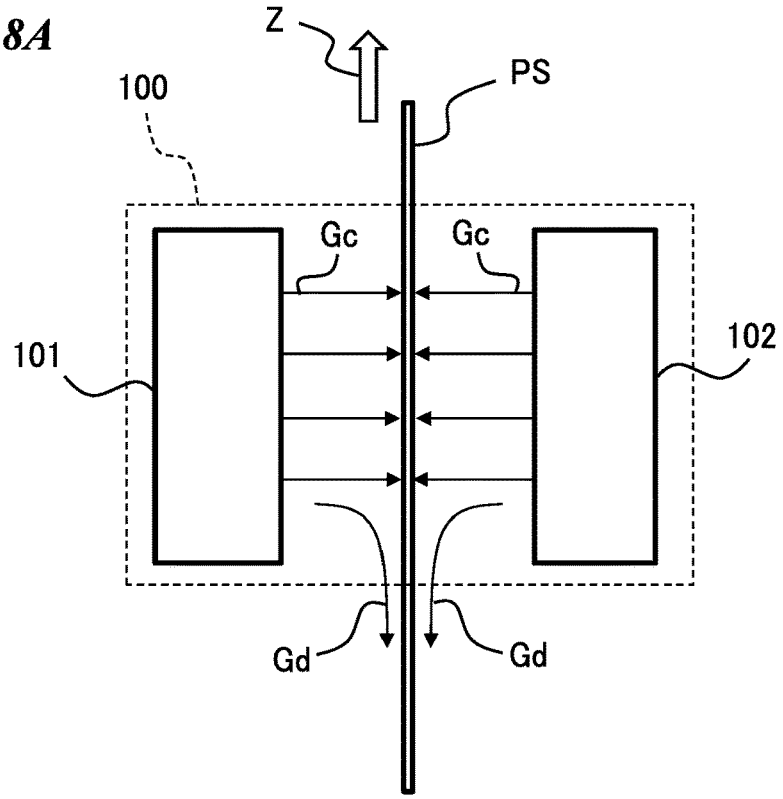
FIG. 8A is a view when a cooling device 100 of the related art is seen from a width direction of a hot-dip plated steel sheet PS.
Figure 8B:
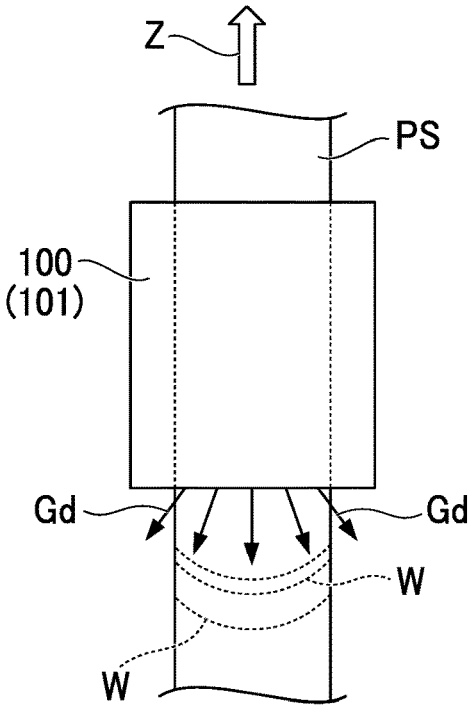
FIG. 8B is a view when the cooling device 100 of the related art is seen from a thickness direction of the hot-dip plated steel sheet PS (in a direction perpendicular to a surface of the hot-dip plated steel sheet PS).

(5) In the above-described embodiment, description has been given of a case where the main cooling device 20 and the preliminary cooling device 30 are individually independent devices. In contrast, as shown in FIG. 7, the main cooling device 20 and the preliminary cooling device 30 may be configured integrally with each other. In FIG. 7, a first cooling gas spraying device 51 has a function of the main cooling gas spraying device 21, the first preliminary cooling nozzle 31, the second preliminary cooling nozzle 33, and the third preliminary cooling nozzle 35. In addition, a second cooling gas spraying device 52 has a function of the main cooling gas spraying device 22, the first preliminary cooling nozzle 32, the second preliminary cooling nozzle 34, and the third preliminary cooling nozzle 36.

EXAMPLES

After performing preliminary cooling and main cooling of the hot-dip plated steel sheet by using the cooling device according to the invention, an occurrence situation of a wrinkle on the surface of the hot-dip plated steel sheet was verified. Table 1 and Table 2 show a verification result. Furthermore, in Table 1 and Table 2, "Number of nozzle stages" corresponds to the number of gas collision positions which are set in the preliminary cooling section. In addition, "Nozzle No" represents numbers which are sequentially allocated from the preliminary cooling nozzle of the lowest stage. In other words, "Nozzle No" represents numbers which are sequentially allocated from the gas collision position of the lowest stage.

In Table 1 and Table 2, "angle α(°)" represents an angle (for example, refer to α1 and the like in FIG. 1A) made by the spraying direction of the preliminary cooling gas that is sprayed from the preliminary cooling nozzle to the gas collision position, and the conveyance direction of the hot-dip plated steel sheet. "Ascending flow velocity Vu (m/s)" represents a detection result (flow velocity detection result obtained from the second flow velocity sensor) of a flow velocity of a gas stream that upwardly flows from the gas collision position along the surface of the hot-dip plated steel sheet PS. "Descending flow velocity Vd (m/s)" represents a detection result (flow velocity detection result obtained from the first flow velocity sensor) of the flow velocity Vd of a gas stream that downwardly flows from the gas collision position along the surface of the hot-dip plated steel sheet PS. In Table 1 and Table 2, an upward direction is defined as a positive side, and a downward direction is defined as a negative side. According to this, the ascending flow velocity Vu is shown as a positive value, and the descending flow velocity Vd is shown as a negative value. "Sheet temperature T (° C.) at nozzle position" represents a detection result (temperature detection result obtained from the temperature sensor) of the surface temperature of the hot-dip plated steel sheet PS at the gas collision position.

TABLE 1

| Condition No. | Number of nozzle stages n | Nozzle No. | Angle α (°) | Ascending flow velocity Vu (m/s) | Descending flow velocity Vd (m/s) | Sheet temperature at nozzle position T (° C.) | Wrinkle evaluation | Example/ Comparative Example |
|---|---|---|---|---|---|---|---|---|
| 1 | 1 | 1 | 30 | 31 | −14 | 420 | D | Comparative Example |
| 2 | 1 | 1 | 30 | 17 | −6 | 428 | D | Comparative Example |
| 3 | 1 | 1 | 90 | 21 | −20 | 420 | D | Comparative Example |
| 4 | 1 | 1 | 70 | 62 | −44 | 420 | D | Comparative Example |
| 5 | 2 | 2 | 90 | 14 | −14 | 418 | C | Example |
| | | 1 | 90 | 14 | −14 | 420 | | |
| 6 | 2 | 2 | 30 | 31 | −14 | 418 | C | Example |
| | | 1 | 30 | 31 | −14 | 420 | | |
| 7 | 3 | 3 | 30 | 31 | −14 | 415 | B | Example |
| | | 2 | 30 | 31 | −14 | 418 | | |
| | | 1 | 30 | 31 | −14 | 420 | | |
| 8 | 4 | 4 | 90 | 8 | −8 | 423 | C | Example |
| | | 3 | 90 | 8 | −8 | 425 | | |
| | | 2 | 90 | 8 | −8 | 426 | | |
| | | 1 | 90 | 8 | −8 | 428 | | |

TABLE 1-continued

| Condition No. | Number of nozzle stages n | Nozzle No. | Angle α (°) | Ascending flow velocity Vu (m/s) | Descending flow velocity Vd (m/s) | Sheet temperature at nozzle position T (° C.) | Wrinkle evaluation | Example/ Comparative Example |
|---|---|---|---|---|---|---|---|---|
| 9 | 4 | 4 | 90 | 13 | −13 | 421 | B | Example |
| | | 3 | 90 | 13 | −13 | 423 | | |
| | | 2 | 90 | 13 | −13 | 425 | | |
| | | 1 | 30 | 34 | −10 | 428 | | |
| 10 | 4 | 4 | 50 | 52 | −24 | 407 | A | Example |
| | | 3 | 40 | 56 | −20 | 415 | | |
| | | 2 | 30 | 50 | −15 | 422 | | |
| | | 1 | 20 | 48 | −10 | 428 | | |
| 11 | 6 | 6 | 90 | 17 | −17 | 399 | A | Example |
| | | 5 | 90 | 17 | −17 | 403 | | |
| | | 4 | 90 | 17 | −17 | 407 | | |
| | | 3 | 90 | 17 | −17 | 412 | | |
| | | 2 | 90 | 17 | −17 | 416 | | |
| | | 1 | 90 | 17 | −17 | 420 | | |

TABLE 2

| Condition No. | Number of nozzle stages n | Nozzle No. | Angle α (°) | Ascending flow velocity Vu (m/s) | Descending flow velocity Vd (m/s) | Sheet temperature at nozzle position T (° C.) | Wrinkle evaluation | Example/ Comparative Example |
|---|---|---|---|---|---|---|---|---|
| 12 | 7 | 7 | 90 | 17 | −17 | 395 | A | Example |
| | | 6 | 90 | 17 | −17 | 399 | | |
| | | 5 | 90 | 17 | −17 | 403 | | |
| | | 4 | 90 | 17 | −17 | 407 | | |
| | | 3 | 90 | 17 | −17 | 412 | | |
| | | 2 | 90 | 17 | −17 | 416 | | |
| | | 1 | 90 | 17 | −17 | 420 | | |
| 13 | 7 | 7 | 80 | 33 | −25 | 379 | AA | Example |
| | | 6 | 70 | 38 | −27 | 386 | | |
| | | 5 | 60 | 45 | −27 | 393 | | |
| | | 4 | 50 | 49 | −26 | 400 | | |
| | | 3 | 40 | 52 | −23 | 408 | | |
| | | 2 | 30 | 58 | −19 | 415 | | |
| | | 1 | 20 | 56 | −14 | 422 | | |
| 14 | 10 | 10 | 50 | 60 | −26 | 391 | AA | Example |
| | | 9 | 50 | 59 | −26 | 400 | | |
| | | 8 | 50 | 52 | −24 | 408 | | |
| | | 7 | 50 | 45 | −20 | 415 | | |
| | | 6 | 50 | 35 | −15 | 421 | | |
| | | 5 | 50 | 24 | −11 | 427 | | |
| | | 4 | 40 | 21 | −7 | 431 | | |
| | | 3 | 30 | 15 | −4 | 434 | | |
| | | 2 | 30 | 5 | −2 | 436 | | |
| | | 1 | 20 | 3 | 0 | 437 | | |

Five-stage evaluation was made with respect to the wrinkle occurrence situation. That is, "D" represents a case where a passing grade as a product is not reached. "C" represents a case where the passing grade as a product is barely reached. "B" represents a case where the passing grade as a product is reached with a margin. "A" represents a case where the passing grade as a product is reached with a margin, and an excellent appearance in which a wrinkle is less is provided. "AA" represents a case where the passing grade as a product is reached with a margin, and a very excellent appearance in which the wrinkle hardly occurs is provided.

As shown in Table 1 and Table 2, in the entirety of Examples 5 to 14 of the invention, the wrinkle occurrence situation reached the passing grade as a product. Particularly, it was confirmed that in a configuration of spraying the preliminary cooling gas to three or greater gas collision positions set along the preliminary cooling section in an obliquely upward direction, and a configuration in which the closer the gas collision position is to the lower stage of the preliminary cooling section, the smaller the angle α made by the spraying direction of the preliminary cooling gas and the conveyance direction of the hot-dip plated steel sheet becomes, the evaluation on the wrinkle occurrence situation was high.

In contrast, in the entirety of Comparative Examples 1 to 4 in which the preliminary cooling nozzle is provided only in one stage (the number of the gas collision positions set in the preliminary cooling section is "1"), it was confirmed that the wrinkle occurrence situation does not reach the passing grade as a product.

BRIEF DESCRIPTION OF THE REFERENCE SYMBOLS

1: SNOUT
2: HOT-DIP PLATING POT
3: HOT-DIP PLATING BATH
4: IN-BATH FOLDING ROLL
5: IN-BATH SUPPORTING ROLL
6: PLATING THICKNESS CONTROL DEVICE
7, 8: WIPING NOZZLE
10: COOLING DEVICE
20: MAIN COOLING DEVICE
21, 22: MAIN COOLING GAS SPRAYING DEVICE
21*a*: SLIT NOZZLE
30, 30A, 40: PRELIMINARY COOLING DEVICE
31, 32: FIRST PRELIMINARY COOLING NOZZLE
33, 34: SECOND PRELIMINARY COOLING NOZZLE
35, 36: THIRD PRELIMINARY COOLING NOZZLE
31*a*, 32*a*: TEMPERATURE SENSOR
31*b*, 32*b*: FIRST FLOW VELOCITY SENSOR
31*c*, 32*c*: SECOND FLOW VELOCITY SENSOR
37: FIRST CONTROL DEVICE
38: SECOND CONTROL DEVICE
41, 42: PRELIMINARY COOLING GAS SPRAYING DEVICE
51: FIRST COOLING GAS SPRAYING DEVICE
52: SECOND COOLING GAS SPRAYING DEVICE
PS: HOT-DIP PLATED STEEL SHEET
S: STEEL SHEET
Z: CONVEYANCE DIRECTION
W: WRINKLE
Gc: COOLING GAS
Gd: DESCENDING GAS STREAM
Gs: PRELIMINARY COOLING GAS
P1: GAS COLLISION POSITION

The invention claimed is:

1. A cooling device for a hot-dip plated steel sheet which is provided on an upper side of a plating thickness control device, including a pair of wiping nozzles, in a conveyance route of the hot-dip plated steel sheet that is conveyed from a plating bath in a vertically upward direction, the cooling device comprising:

a main cooling device, including a plurality of main cooling gas spraying nozzles, that vertically sprays a main cooling gas to the hot-dip plated steel sheet; and a preliminary cooling device, including a plurality of preliminary cooling nozzles, that is provided in a preliminary cooling section between the main cooling device and the plating thickness control device in the conveyance route, and sprays a preliminary cooling gas to a plurality of gas collision positions which are set along the preliminary cooling section, wherein the preliminary cooling device sprays the preliminary cooling gas to each of the gas collision position in an obliquely upward direction, and wherein the closer the gas collision position is to a lower stage of the preliminary cooling section, the smaller an angle, which is made by a spraying direction of the preliminary cooling gas and the conveyance direction of the hot-dip plated steel sheet, becomes.

2. The cooling device for a hot-dip plated steel sheet according to claim 1, wherein the preliminary cooling device comprises:

a temperature sensor that detects a surface temperature of the hot-dip plated steel sheet at the gas collision position of at least a lowest stage, a first flow velocity sensor that detects a flow velocity of a gas stream that downwardly flows from the gas collision position of at least the lowest stage along a surface of the hot-dip plated steel sheet, and a first controller that is configured to control an ejection flow velocity of the preliminary cooling gas that is sprayed to the gas collision position of at least the lowest stage on the basis of a temperature detection result obtained from the temperature sensor and a flow velocity detection result that is obtained from the first flow velocity sensor, and wherein when the temperature detection result obtained from the temperature sensor is defined as T (° C.), the flow velocity detection result obtained from the first flow velocity sensor is defined as Vd (m/s), and a limit descending flow velocity, at which a wrinkle occurs on the surface of the hot-dip plated steel sheet, is defined as a wrinkle occurrence limit descending flow velocity VL1 (m/s), the first controller is configured to control the ejection flow velocity of the preliminary cooling gas that is sprayed to the gas collision position of the lowest stage in order for the following Expression (3) and Expression (4) to be satisfied with respect to the gas collision position of at least the lowest stage, $$VL1=A\cdot(T-C)^2+B\cdot(T-C)-D \quad (3)$$

$$|Vd|\leq|VL1| \quad (4)$$

(in Expression (3), A, B, C, and D represent integers).

3. The cooling device for a hot-dip plated steel sheet according to claim 2, wherein when a solidification initiation temperature of the hot-dip plated steel sheet is defined as Ts (° C.), the first controller performs a control of the ejection flow velocity in a case where the temperature detection result T (° C.) obtained from the temperature sensor satisfies the following Conditional Expression (5):

$$Ts-49\leq T\leq Ts+9 \quad (5).$$

4. The cooling device for a hot-dip plated steel sheet according to claim 1, wherein the preliminary cooling device comprises:

a second flow velocity sensor that detects a flow velocity of a gas stream that flows from the gas collision position of at least a lowest stage to an upward direction along a surface of the hot-dip plated steel sheet, and a second controller that is configured to control an ejection flow velocity of the preliminary cooling gas that is sprayed to the gas collision position of at least the lowest stage on the basis of a flow velocity detection result obtained from the second flow velocity sensor, and wherein when the flow velocity detection result obtained from the second flow velocity sensor is defined as Vu (m/s), and a limit ascending flow velocity, at which a wrinkle occurs on a surface of the hot-dip plated steel sheet, is defined as a wrinkle occurrence limit ascending flow velocity VL2 (m/s), the second controller is configured to control the ejection flow velocity of the preliminary cooling gas that is sprayed to the gas collision position of the lowest stage in order for the following Expression (6) to be satisfied with respect to the gas collision position of at least the lowest stage, $$|Vu|\leq|VL2| \quad (6).$$

5. The cooling device for a hot-dip plated steel sheet according to claim 1, wherein the preliminary cooling device comprises a plurality of preliminary cooling nozzles which are individually independent.

6. The cooling device for a hot-dip plated steel sheet according to claim 5, wherein the preliminary cooling device is provided with a gap, through which the preliminary cooling gas that is used in cooling of the hot-dip plated steel sheet is discharged, between the preliminary cooling nozzles adjacent to each other.

7. The cooling device for a hot-dip plated steel sheet according to claim 1, wherein the main cooling device and the preliminary cooling device are configured integrally with each other.

* * * * *